US005156312A

United States Patent [19]

Kurie

[11] Patent Number: 5,156,312

[45] Date of Patent: Oct. 20, 1992

[54] FLOTATION NOZZLE FOR WEB HANDLING EQUIPMENT

[75] Inventor: Eugene J. Kurie, Bridgewater, N.J.

[73] Assignee: Somerset Technologies, Inc., Somerset, N.J.

[21] Appl. No.: 459,343

[22] Filed: Dec. 29, 1989

[51] Int. Cl.[5] ..... B65H 20/14; F26B 13/00

[52] U.S. Cl. ..... 226/97; 34/156; 226/7

[58] Field of Search ..... 226/7, 97; 34/156, 160, 34/57 R, 57 A; 137/625.33; 251/205

[56] References Cited

U.S. PATENT DOCUMENTS

| | | | |
|---|---|---|---|
| 2,576,848 | 11/1951 | Mercier et al. | 137/625.33 |
| 2,601,231 | 6/1952 | Smith et al. | 137/625.33 |
| 3,302,550 | 2/1967 | Thomson | 137/625.33 X |
| 3,334,896 | 8/1967 | Mullin | 137/625.33 X |
| 4,069,595 | 1/1978 | Ahlbert et al. | 226/97 X |
| 4,414,757 | 11/1983 | Whipple | 226/97 X |
| 4,678,914 | 10/1987 | Shu et al. | 226/97 X |
| 4,785,986 | 11/1988 | Daane et al. | 226/97 |
| 4,833,794 | 5/1989 | Stibbe et al. | 34/156 |
| 4,848,633 | 7/1989 | Hagen et al. | 226/97 |
| 4,854,052 | 8/1989 | Korpela | 34/156 X |

FOREIGN PATENT DOCUMENTS

| | | | |
|---|---|---|---|
| 0006551 | 1/1985 | Japan | 226/97 |

*Primary Examiner*—Daniel P. Stodola
*Assistant Examiner*—P. Bowen
*Attorney, Agent, or Firm*—Fay, Sharpe, Beall, Fagan, Minnich & McKee

[57] ABSTRACT

A nozzle box assembly for use in apparatus for supporting and guiding a horizontally moving web of sheet material comprises an elongated housing defining an elongated, first chamber which extends centrally and axially of the housing. Second and third chambers are located on opposite sides of the first chamber and extend parallel thereto. The second and third chambers each include an elongated discharge nozzle slot extending parallel to the first chamber. Pressurized gas is supplied to the first chamber and a first and a second plurality of flow openings in the housing respectively act to conduct gas from the first chamber to the second and third chambers in a particularly uniform manner. First and second independently operable valves are mounted in the housing for controlling gas flow through the first and said second plurality of flow openings to thereby control flow to the second and third chambers and from the discharge nozzle slots.

10 Claims, 5 Drawing Sheets

FLOTATION NOZZLE FOR WEB HANDLING EQUIPMENT

BACKGROUND OF THE INVENTION

The subject invention is directed toward the art of web handling equipment and, more particularly, to an improved flotation nozzle design.

Systems for supporting and conveying a continuous moving web of material during processing such as drying, curing, baking, cooling or the like, typically comprise a multiple number of Coanda flotation nozzles positioned on opposite sides of the path of movement of the web. The nozzles are generally positioned along the entire span of floated web material in close proximity above and below the web. The nozzles direct air under considerable pressure through fixed slot openings which extend across the width of the web.

The typical prior art nozzle designs use a common air pressure chamber from which air is forced through at least two of the fixed slot type discharge openings on laterally opposite sides of the nozzle body to form an air pressure area at a Coanda surface of the nozzle between the discharge openings to thereby apply a force against the web of material traveling across the nozzle.

The flotation characteristics of the nozzles depend upon the uniformity of air flow through the nozzles and should desirably vary depending upon variations in the speed of movement of the web or when the type and weight of the web material changes. However, with the prior nozzle designs it has generally not been possible to maintain uniform flow throughout the length of the nozzles or to change the flotation characteristics of the individual nozzles. Thus, in any particular system, the ability to function efficiently at different web speeds or with different web materials was severely limited.

BRIEF STATEMENT OF THE INVENTION

By use of the subject invention, it is possible to quickly and effectively change the flotation characteristics of the individual nozzles to allow the web handling equipment to most efficiently handle a variety of different web materials, or to allow the equipment to be used with webs traveling at a variety of different speeds.

In particular, and in accordance with one aspect of the invention, there is provided an apparatus for contactless guiding and support of a web of material moving along a generally horizontal path by use of a gas medium. The apparatus comprises a plurality of nozzle box assemblies positioned in side-by-side spaced apart relationship adjacent the path. Each of the nozzle box assemblies includes an elongated housing which defines first and second elongated chambers. The second chamber defines a first gas discharge nozzle slot which extends transversely of the pass and is formed to discharge gas toward the path. Gas supply means are associated with the nozzle box for supplying gas to the first chamber and a plurality of supply orifices in the first chamber open to the second chamber with a first movable valve mounted in the housing and associated with the orifices for controlling the gas flow therethrough to thereby control gas flow from the first discharge nozzle slot.

Preferably, and in accordance with another aspect of the invention, the housing further includes a third chamber with the third chamber defining a second gas discharge nozzle slot extending parallel to the first gas discharge nozzle slot. Additionally, each of the discharge nozzle slots are associated with a Coanda surface located and arranged to cause the air flow from each of the nozzle slots to be directed generally toward the associated nozzle slot. Additionally, a second movable valve is associated with the second gas discharge nozzle slot for controlling the gas flow thereto independent of the flow through the first nozzle slot.

Because of the arrangement of independent controls for the gas flow to the two associated nozzle slots, it is possible to adjust the flow to obtain differential air supply between the nozzle openings. Preferably, the adjustments are such as to provide from zero to one hundred percent air flow from either of the two associated nozzles to allow all differential air flow between the extremes to be obtained, including a fully balanced air flow condition which results from equal flow from both of the discharge nozzles. These adjustments allow the flotation characteristics of the nozzle assemblies to be varied in a manner which is especially beneficial when processing different types and weights of continuous web products in the same drying equipment or when processing such products at different speeds.

Preferably, and in accordance with a still more limited aspect of the invention, the movable valve comprises damper members associated with a multiple number of orifices which connect the first and third chambers with the second chamber. By adjusting the dampers, the orifice openings between the second chamber and the first and third chambers can be varied in whatever manner is desired.

In accordance with a further aspect of the invention, a nozzle box assembly intended for use in supporting and guiding a horizontally moving web of flexible sheet material comprises an elongated housing which defines an elongated first chamber which extends centrally and axially of the housing with second and third chambers located on opposite sides of the first chamber to extend parallel thereto throughout the length thereof. Each of the second and third chambers include an elongated discharge nozzle slot which extends parallel to the first chamber throughout substantially the length of the second and third chambers. Means are provided to supply pressurized air to the first chamber and air flow from the first chamber to the second and third chambers is respectively supplied by a first and a second plurality of flow openings. The flow openings in each plurality are spaced relatively uniformly along the length of first chamber and sized to produce a uniform distribution of pressurized air to the second and third chambers throughout the length thereof to produce a uniform discharge of air through each elongated nozzle slot along the length thereof.

As can be appreciated, this form of the invention provides an extremely uniform distribution of air to the second and third chambers to assure uniform and effective air flow from the nozzle slots. Moreover, this arrangement can be provided with valve elements to allow each nozzle box assembly to be differentially adjusted as most desirably suits the characteristics and speed of the material flowing through a drying or cooling chamber.

Accordingly, a primary object of the invention is the provision of an apparatus of the type described wherein highly uniform and/or differential air flow can be achieved in a simple and highly effective manner.

Yet another object of the invention is the provision of apparatus of the type described wherein the air flow relationships between the associated nozzles and the Coanda reaction surface can be varied to provide a resultant air flow direction as desired.

Another object is the provision of a nozzle box assembly wherein the air flow through the outlet nozzles is extremely uniform throughout the length of the nozzles.

BRIEF DESCRIPTION OF THE DRAWINGS

The above and other objects and advantages will become apparent from the following description when read in conjunction with the accompanying drawings wherein.

DETAILED DESCRIPTION OF THE PREFERRED EMBODIMENT

Figure 1A:
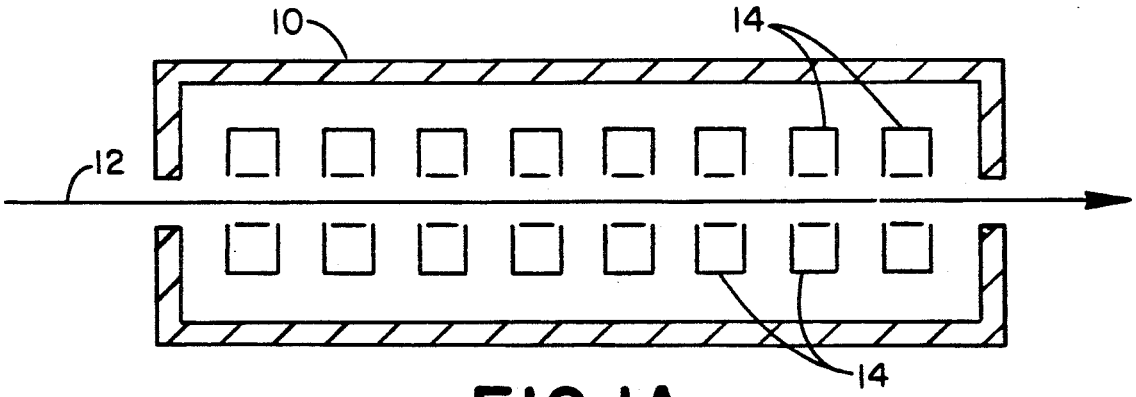
FIG.1A (PRIOR ART)
FIGS. 1A, 1B, and 1C, are diagrammatic elevational showings of typical prior art flotation nozzle arrangements in heating, cooling or drying chambers.
Figure 1B:
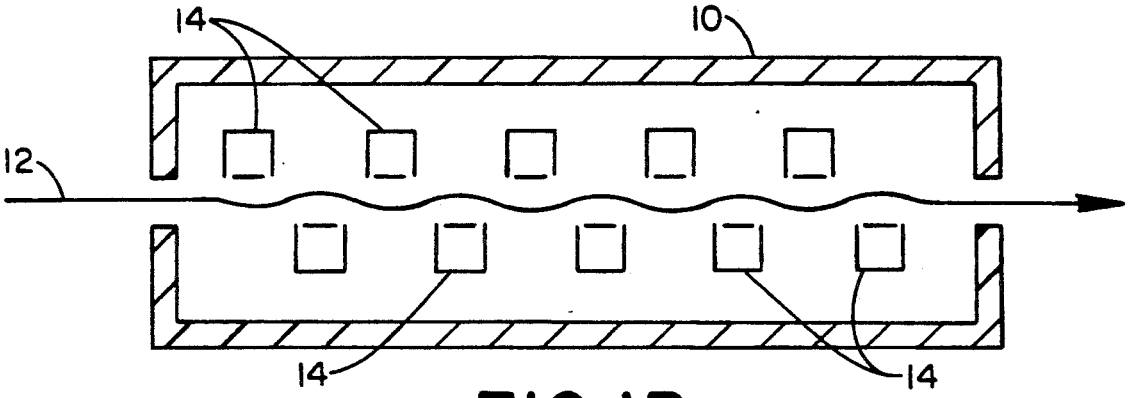
FIG.1B (PRIOR ART)
Figure 1C:
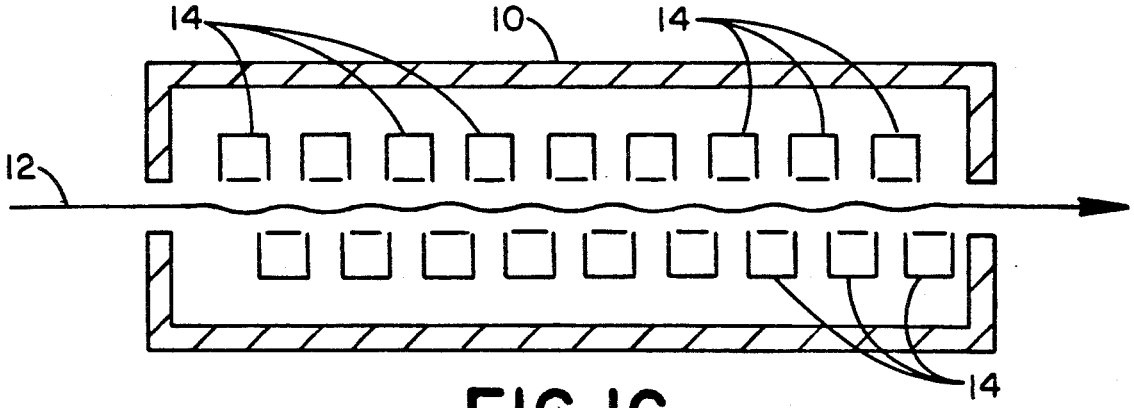
FIG.1C (PRIOR ART)

Referring more particularly to the drawings wherein the showings are for the purpose of illustrating a preferred embodiment of the invention only and not for the purpose of limiting same, FIGS. 1A, 1B, and 1C are diagrammatic illustrations showing prior art arrangements of cooling or drying chambers specifically intended for processing web material. As illustrated, the system generally includes an enclosure or chamber 10 through which a continuous web 12 of thin flexible sheet material travels during processing such as drying, curing, baking, annealing or cooling. The web 12 travels generally horizontally and is guided and supported during its movement through the chamber by upper and lower series of Coanda nozzle boxes 14 which have elongated slot-type nozzles on adjacent sides of Coanda reaction surfaces. The nozzles open generally transversely of the web 12 and direct streams of air or other gaseous material toward the web to support and guide it during high speed movement through the chamber 10. Many different arrangements of the nozzle box assemblies 14 have been used and are currently in use in the art. The FIG. 1A showing illustrates the nozzle box assemblies 14 in direct, aligned and opposing relationship to each other. In the FIG. 1B, the boxes are in full staggered relationship with the upper series fully offset from the lower series. The FIG. 1C showing has the upper and lower series of nozzle boxes partially offset with the nozzles in the top series overlapping those in the lower series. Typically, the arrangement of the nozzle boxes is controlled by the weight and character of the web material being processed as well as the speed at which it is moving through the chamber or past the nozzle units. In any event, however, each particular installation is generally somewhat limited in the scope or range of materials and speeds at which it can effectively operate.

Figure 2:
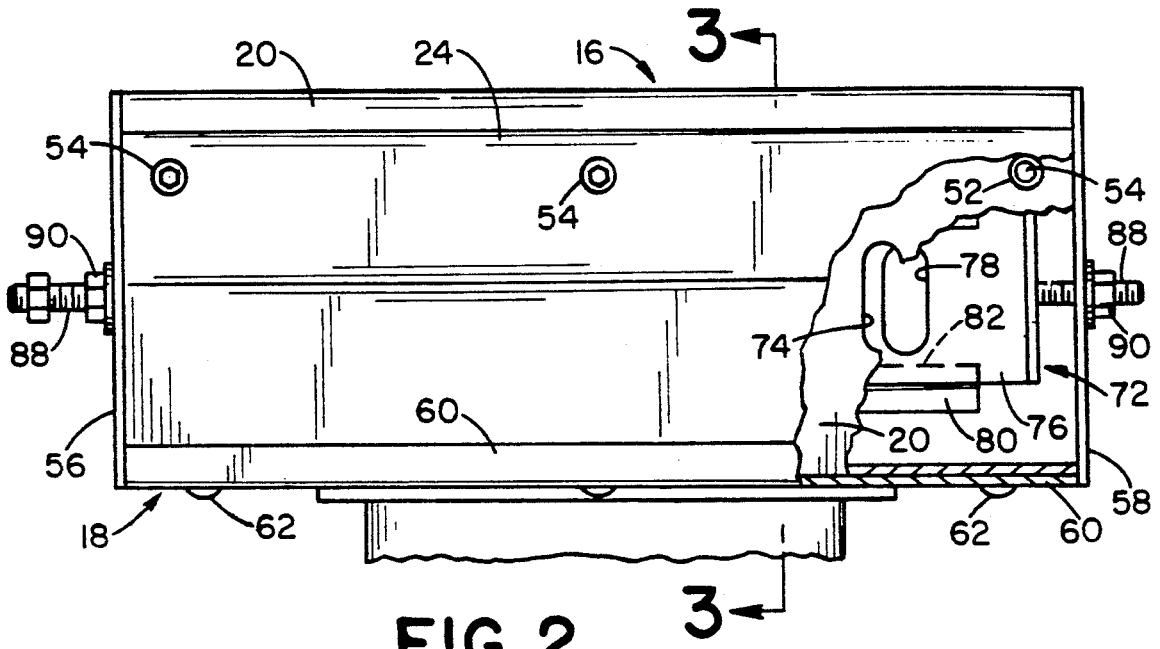
FIG. 2 is a side elevational view of a preferred embodiment of a nozzle box assembly formed in accordance with the preferred embodiment of the invention.
Figure 3:
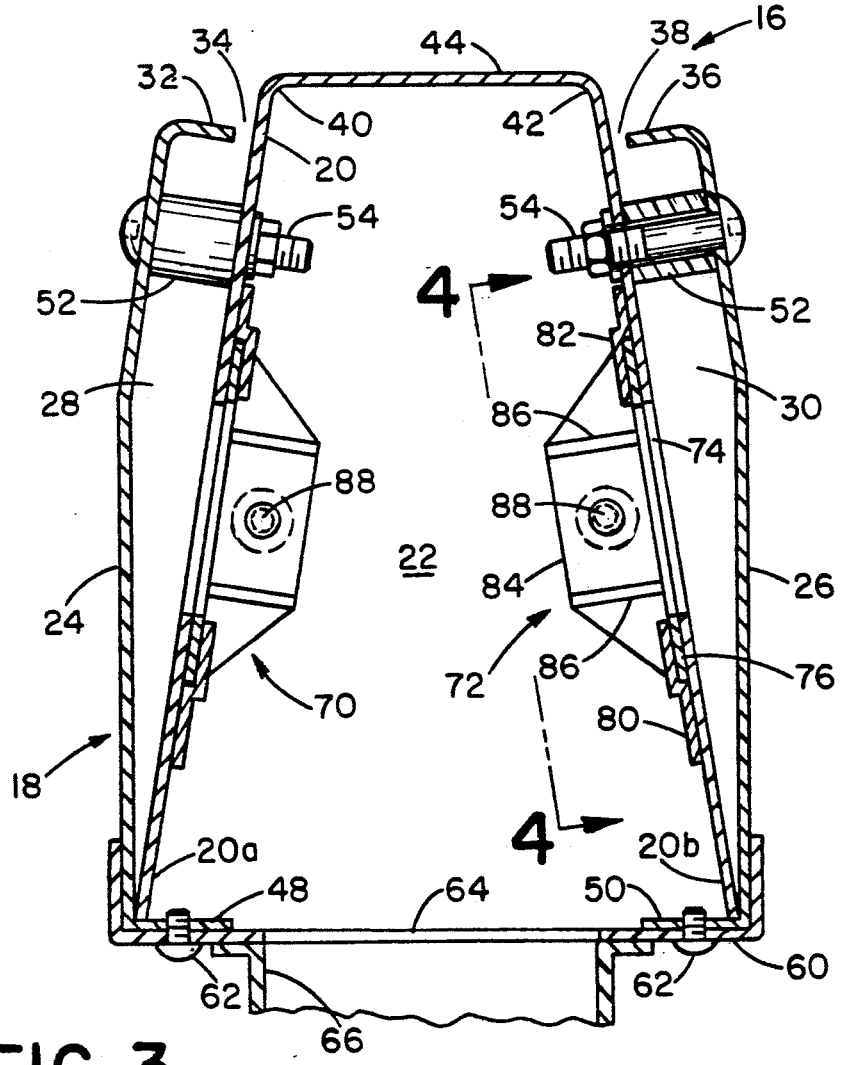
FIG. 3 is a cross-sectional view taken on line 3—3 of FIG. 2.
Figure 4:
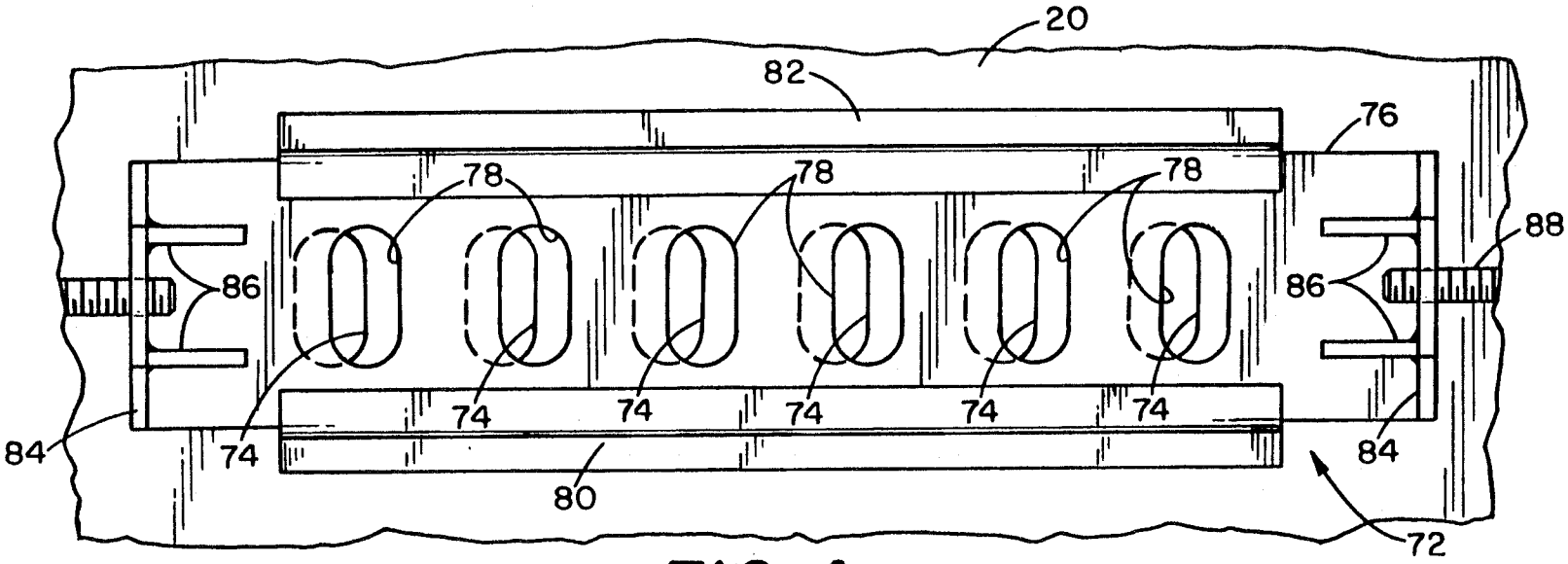
FIG. 4 is a cross-sectional view taken on line 4—4 of FIG. 3.

Referring more particularly to FIGS. 2 through 4, the subject invention provides a Coanda nozzle box assembly 16 which can be used in the systems of FIGS. 1A through 1C and which can be adjusted and controlled to allow the systems to handle a variety of material weights and types at a variety of different speeds. Although the nozzle box assembly 16 could have a variety of specific constructions and configurations, it is generally shown as comprising an elongated housing 18 formed of a suitable material such as sheet metal and comprising a first generally U-shaped member 20 which is positioned in an inverted relation with its legs **20*a* and 20*b* extending downward and defining a first chamber 22 (See FIG. 3). A pair of laterally spaced side members 24 and 26 define second and third chambers 28 and 30, respectively. The chambers 28 and 30 are located on adjacent sides of the member 20 and preferably extend the length of the nozzle box assembly 16**.

As illustrated in FIG. 3, the upper end 32 of the member 24 is bent inwardly toward the left hand side wall **20*a* of member 20 and closely spaced thereto to define a horizontally extending elongated nozzle slot opening 34. Slot 34 also extends the length of the nozzle box assembly 16. The right hand member 26 is similarly arranged and has its upper end 36 bent inwardly toward the right hand side 20*b* of the U-shaped main housing member 20. Its inner end 36 is spaced from the side wall of member 20 to define a second elongated outlet nozzle slot 38 which extends parallel to slot 34 throughout the length of the nozzle box assembly 16. As shown, the nozzle slots 34 and 38 are placed relatively closely adjacent the upper end of the housing member 20. Additionally, the housing member 20 is gently curved at corners 40 and 42 as shown. The horizontal upper surface 44 of member 20** thus defines a Coanda reaction plate surface.

The side members 24 and 26 are provided with inwardly turned or flanged lower end portions 48 and 50, respectively. Preferably, members 24 and 26 are joined to the lower ends of the legs of member 20 by being tack welded or otherwise positively connected thereto. At their upper ends, the members 24 and 26 are joined to the legs of member 20 in a manner to maintain the desired close and accurate spacing of the nozzle outlet slots 34, 38. According to the subject embodiment, these connecting means comprise a plurality of tubular spacer members 52 and socket head bolt and nut assemblies 54. As best illustrated in FIG. 2, there are three of the spacer and bolt assemblies 52, 54 spaced along each side of the nozzle box assembly 16.

The opposite ends of the nozzle box assembly are closed by a suitable end walls 56, 58 best illustrated in FIG. 2. The lower end of the nozzle box assembly is desirably closed by a generally U-shaped plate member 60 which is connected to the inturned ends 48, 50 of the side members 24, 26, respectively. In the embodiment under consideration, the bottom wall 60 is removably connected to these members 24, 26 by suitable self-tapping machine screws 62.

A suitable air inlet opening 64 is formed through the bottom wall 60 of the nozzle box assembly 16. The opening 64 provides a means for supplying air under pressure to the chamber 22. For this reason, a suitable reinforcing flange assembly 66 is connected about the opening 64 and provides means for connecting and supporting the nozzle box assembly from an associated air supply duct or the like not shown.

Figure 3A:
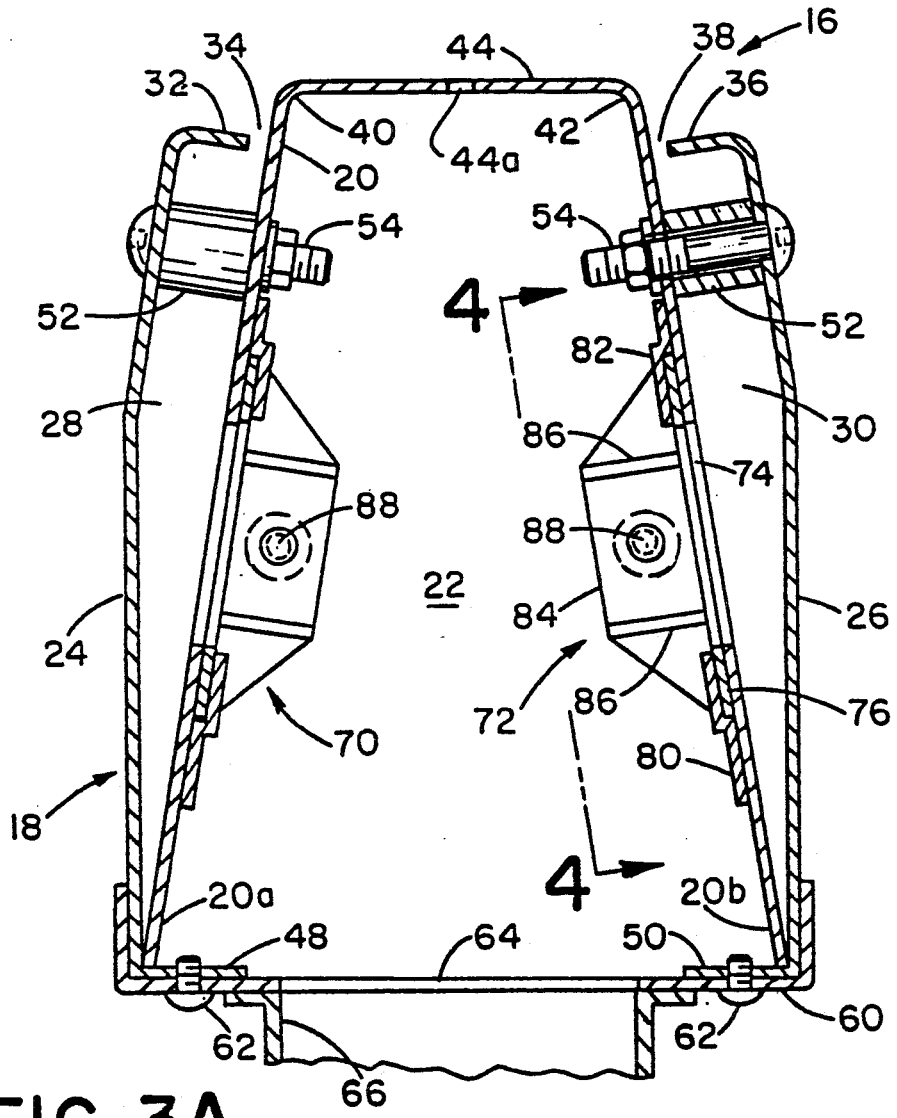
FIG. 3A is a partial cross-sectional view similar to FIG. 3 but showing a modified form of construction.

The chamber 22 comprises the main air supply chamber for the nozzle box assembly 16 and is in communication with the side chambers 28 and 30 through openings which will subsequently be discussed. The air from chamber 22 passes into the side chambers 28 and 30 and is discharged through the elongated nozzle slots 34 and 38. As is customary with this type of nozzle box assembly, the air exiting from the elongated discharge nozzle slot is deflected upwardly over the Coanda plate surface 44 to create a turbulent and dynamic air condition between the surface 44 and the surface of the adjacent web (See FIGS. 1A through 1C). Under certain circumstances, it is desirable, as shown in FIG. 3A, to provide an elongated discharge slot 44*a* opening from the first chamber 22 and extending parallel to the elongated discharge nozzle slots, 34, 38 in the second and third chambers 28, 30, respectively.

Of particular importance to the subject invention is the arrangement whereby the air flow through the discharge nozzle slots 34, 38 is controlled to be particularly uniform throughout the length of the nozzle slots and can further, if desired, be regulated and controlled to obtain differential air flow between these openings to allow the flotation characteristics of the nozzle to be changed when processing different types and weights of continuous web products or when processing such products at different speeds. In the subject invention, these means comprise separate assemblies 70, 72, respectively. The assemblies 70, 72 are arranged to produce a very uniform flow of air from the main supply chamber 22 to the chambers 28, 30 and to allow the air to be closely adjusted and regulated to achieve a desired outflow through the associated discharge nozzle slots 34, 38. Although many different types of arrangements could be used for controlling this flow, the subject embodiment uses the two assemblies 70, 72 which are identical in construction and, accordingly, only assembly 72 will be described in detail. However, the description of assembly 72 should be considered as equally applicable to assembly 70. In particular, as best shown in FIGS. 2 and 4, assembly 72 includes a series of orifices 74 which are formed through the right hand side wall of member 20. The orifices 74 are preferably uniformly spaced along the length of the housing 18 in the manner illustrated. Additionally, the sizing of the orifices is related to their spacing and the total air flow so that an extremely uniform flow of air takes place from the central chamber 22 to chambers 28, 30. By spacing and sizing the orifices uniformly along the length of the housing a better and more uniform distribution of air to chamber 30 is achieved. This, in turn, results in a much more uniform flow from nozzle slot 38 than was possible with prior designs. The nozzle box assembly can be effectively used in many installations in the form thus far described; however, in its most desirable form the invention further includes valve members for controlling and permitting regulation of the quantity of flow to chambers 28, 30. For this reason, associated with each series of the orifices 74 and positioned in overlying relationship thereto, is a slide baffle plate or elongated damper member 76 which has a plurality of orifices 78 formed therethrough. The orifices 78 are preferably sized and spaced to generally correspond to the associated orifices 74. Thus, each slide baffle plate 76 can be independently moved horizontally to bring the openings 78 into alignment with the orifices 74 to allow maximum air flow from chamber 22 to the associated chamber 28 or 30. Of course, the slide plates 76 can be adjusted to any position from the full open position to a full closed position wherein the orifices are totally out of alignment and the imperforate portions of the plate 76 overly the respective inlet orifices 74.

As best illustrated in FIG. 4, each slide plate 76 is carried for free horizontal sliding movement by a pair of horizontally extending guide members 80, 82 which are formed as shown in FIG. 3 and tack welded to the inner surface of the right hand wall of member 20. These members thus act to guide and locate the associated slide plate 76. The end of each plate 76 is provided with an outwardly extending bracket member 84 as shown in FIG. 4. Each bracket 84 is desirably reinforced by transversely extending brace members 86 joined between the brackets 84 and the plates 74 as shown. The means for adjusting the position of the slide plate 76 comprise threaded studs 88 joined to the bracket 84 and extending through suitable openings formed in the end walls 56, 58 as shown. Threaded nuts 90 are associated with each of the threaded studs 88 to allow adjustment in positioning as desired.

Figure 5C:
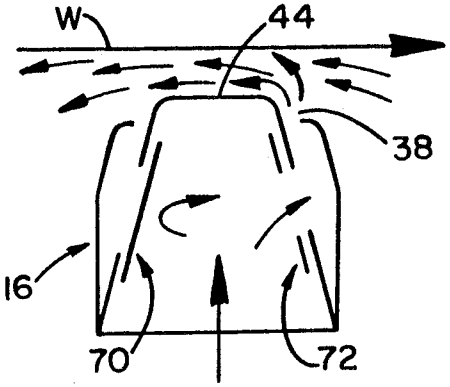
FIGS. 5A, 5B, and 5C, are diagrammatic transverse cross-sections showing the effect of air flow variations in the nozzle box assembly of FIG. 2; and, FIG. 6 is a diagrammatic longitudinal cross-sectional view illustrating one method of use of the invention for processing light weight material at high speeds.
Figure 5B:
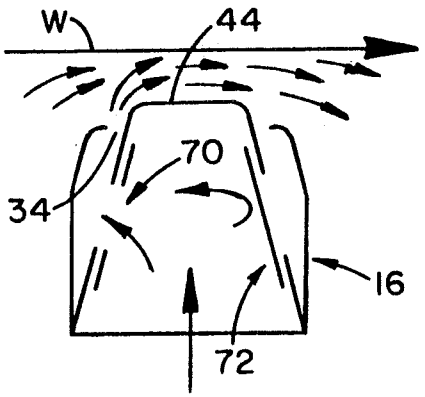
Figure 5A:
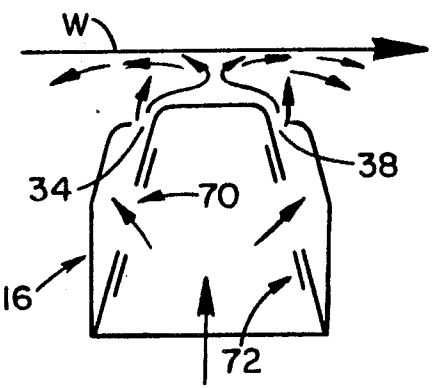

FIGS. 5A through 5C illustrate the various positions of adjustment of the control valves of assemblies 70, 72. In each of these showings, the nozzle box assembly 16 is illustrated as positioned beneath a moving web W. In FIG. 5A, each of the control valves of assemblies 70, 72 are shown in a balanced, full opened position so that the air flow through the lined slots 34, 38 is at a maximum. Under these conditions, the air flow pattern underneath the web W and above the Coanda surface is such as to produce a full balanced flow as illustrated.

In the FIG. 5B showing, the valve of assembly 70 is in a full opened position and the valve of assembly 72 is closed. Under these conditions, air exiting from nozzle slot 34 is at a maximum and a resulting air flow as shown by the arrows takes place to the right over the Coanda reaction surface 44.

FIG. 5C illustrates the reverse condition from FIG. 5B. That is, the control valve of assembly 70 is closed and that of assembly 72 is full opened to produce maximum flow through the outlet nozzle slot 38. This causes a flow to the left as viewed in FIG. 5C.

Figure 6:
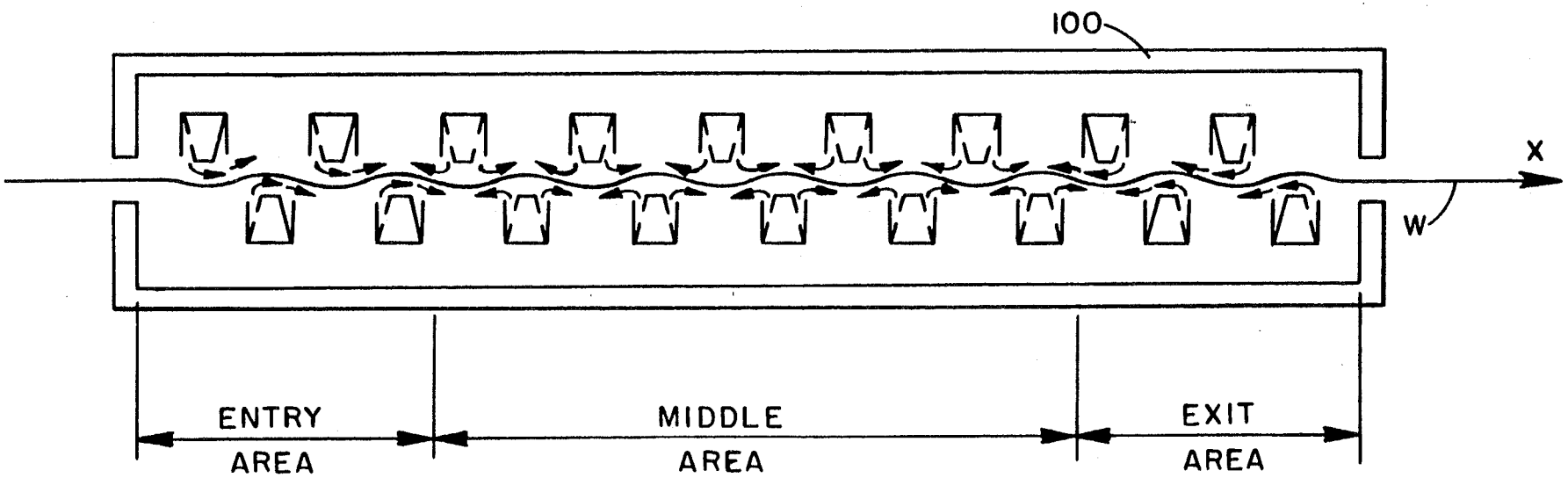

FIG. 6 illustrates how the nozzle assemblies 16 can be used in a system which is processing light weight materials at high speeds. In the FIG. 6 showing, the web W is travelling from left to right through the treatment chamber 100. Two continuous series of the nozzles 16 are positioned above and below the moving web W in a full staggered relationship as discussed with reference to FIG. 8. In this showing, each of the first nozzles in the entry area are adjusted to produce a flow from left to right to provide a gentle float and a low rate of heat transfer. The nozzles in the middle area are adjusted so as to produce a balanced flow which produces a good float on the web material with a high rate of heat transfer. The exit nozzles in the exit area are, however, adjusted so as to produce an induced air flow from the right to the left opposite the direction of movement of the web W. This produces gentle flow with a low rate of heat transfer. It also prevents mass air movement caused by the high speed travel of the web and prevents air from spilling from the housing 100 through the web exit opening.

As can be seen, the subject invention allows the flow characteristics along the path of movement of the web to be adjusted as desired. The desired flotation and flow characteristics can be produced irrespective of the nature of the web or its speed of processing.

The invention has been described in great detail sufficient to enable one of ordinary skill in the art to make and use the same. Obviously, modifications and alterations of the preferred embodiment will occur to others upon the reading and understanding of the subject specification.

What is claimed is:

1. A nozzle box assembly for use in apparatus for supporting and guiding a horizontally moving web of sheet material comprising:

an elongated housing including wall means for defining first, second, and third chambers including an elongated, first chamber which extends centrally and axially of second and third chambers which are located on opposite sides of said first chamber and parallel thereto;

said second and third chambers each including an elongated discharge nozzle slot extending parallel to said first chamber;

means for supplying pressurized gas to said first chamber;

a first plurality of flow openings in said housing for conducting gas from said first chamber to said second chamber;

a second plurality of flow openings in said housing for conducting gas from said first chamber to said third chamber; and first and second independently operable valve means mounted in said housing for controlling gas flow through said first and said second plurality of flow openings to thereby control flow to said second and third chambers and from said discharge nozzle slots.

2. A nozzle box assembly as defined in claim 1 wherein said first and second valve means comprise elongated slide plate members movable longitudinally of said first chamber.

3. A nozzle box assembly as defined in claim 1 including an outlet nozzle slot opening from said first chamber in parallel to said elongated discharge nozzle slots in said second and third chambers.

4. A nozzle box assembly as defined in claim 1 including operating means extending outwardly of said first chamber for controlling said movable valve means.

5. A nozzle box assembly as defined in claim 1 wherein said first plurality and said second plurality of flow openings are each comprised of a series of openings relatively uniformly spaced axially of said housing.

6. A nozzle box assembly as defined in claim 5 wherein said first and second independently movable valve means comprise separate valve plates mounted for movement longitudinally of the first chamber.

7. Apparatus for contactless guiding and support of a web of material moving along a generally horizontal path by use of a gas medium comprising:

a series of nozzle box assemblies positioned in side-by-side spaced apart aligned relationship above and below said path;

each said nozzle box assembly in said series including an elongated housing defining a spaced pair of gas discharge nozzle slots extending transversely of said path and formed to discharge gas generally toward said path with a Coanda plate surface between each spaced pair to cause the gas discharged from each slot to have a component of motion toward the other slot of that respective pair of slots; and, control means for selectively varying the quantity of air discharged from each slot independently of the other slot in the same nozzle box assembly to thereby allow variation in the resultant direction of gas discharge from each nozzle box assembly.

8. The apparatus as defined in claim 7 wherein the control means includes separate adjustable valves for controlling the amount of air supplied to each respective slot.

9. The apparatus as defined in claim 7 wherein said elongated housing includes a separate elongated air supply chamber for each said nozzle slot, and wherein said control means includes a separate valve for controlling the air quantity supplied to each said air supply chamber.

10. The apparatus as defined in claim 7 wherein said control means comprises a separate slide valve associated with each discharge nozzle slot.

* * * * *